US010634133B2

(12) United States Patent
Johnson et al.

(10) Patent No.: US 10,634,133 B2
(45) Date of Patent: Apr. 28, 2020

(54) ELECTRONIC SYSTEMS FOR CONTROLLING SUBMERSIBLE PUMPS

(71) Applicant: See Water, Inc., San Jacinto, CA (US)

(72) Inventors: Michael R. Johnson, Murrieta, CA (US); Franklin J. Cathell, Tucson, AZ (US)

(73) Assignee: See Water, Inc., San Jacinto, CA (US)

( * ) Notice: Subject to any disclaimer, the term of this patent is extended or adjusted under 35 U.S.C. 154(b) by 254 days.

(21) Appl. No.: 15/626,445

(22) Filed: Jun. 19, 2017

(65) Prior Publication Data

US 2018/0363639 A1 Dec. 20, 2018

(51) Int. Cl.

| | |
|---|---|
| ***F04B 49/06*** | (2006.01) |
| ***F04B 23/04*** | (2006.01) |
| ***F04B 23/02*** | (2006.01) |
| ***F04B 49/025*** | (2006.01) |
| ***F04B 49/10*** | (2006.01) |
| *H01F 29/02* | (2006.01) |

(52) U.S. Cl.

CPC ..... *F04B 49/06* (2013.01); *F04B 23/02* (2013.01); *F04B 23/04* (2013.01); *F04B 49/025* (2013.01); *F04B 49/10* (2013.01); *F04B 2207/70* (2013.01); *H01F 29/025* (2013.01)

(58) Field of Classification Search

None

See application file for complete search history.

(56) References Cited

U.S. PATENT DOCUMENTS

| | | | | |
|---|---|---|---|---|
| 3,005,411 | A * | 10/1961 | Metz | F04D 15/0072 417/6 |
| 4,897,022 | A * | 1/1990 | Hudson | E03B 5/02 417/540 |
| 5,190,442 | A * | 3/1993 | Jorritsma | F04D 15/0083 417/12 |
| 6,077,044 | A * | 6/2000 | Reid | E03B 11/10 417/2 |
| 6,178,393 | B1 * | 1/2001 | Irvin | F04D 15/0066 700/282 |
| 6,186,743 | B1 * | 2/2001 | Romer | F04B 41/06 361/191 |

(Continued)

OTHER PUBLICATIONS

Single Phase Duplex Demand WD1 P-4 Wastewater Panel as archived and printed May 10, 2017, in 3 pages. URL: https://web.archive.org/web/20170510192559/http://www.seewaterinc.com/product/single-phase-duplex-demand-wd1p-4.

(Continued)

*Primary Examiner* — Peter J Bertheaud
*Assistant Examiner* — Geoffrey S Lee
(74) *Attorney, Agent, or Firm* — Knobbe Martens Olson & Bear LLP

(57) ABSTRACT

Electronic systems for controlling submersible pumps are provided herein. In certain configurations, a pump system includes three or more submersible pumps used for pumping fluid from a reservoir, sensors used for generating sense signals indicating a fluid level of the reservoir, and a control circuit for selectively activating the pumps based on the sense signals so as to control pumping of fluids from the reservoir. In certain implementations, the control circuit is operable in a plurality of user-selectable operating modes associated with different pump activation sequences in response to the fluid level of the reservoir rising.

10 Claims, 6 Drawing Sheets

(56) References Cited

U.S. PATENT DOCUMENTS

| | | | | |
|---|---|---|---|---|
| 7,972,117 | B1 | 7/2011 | MacDonald | |
| 8,371,821 | B1 * | 2/2013 | Mehr | F04B 47/06 417/12 |
| 9,525,309 | B2 * | 12/2016 | Cummings | H02J 9/062 |
| 2015/0326152 | A1 * | 11/2015 | Becerra | H02M 5/12 318/400.3 |
| 2017/0145666 | A1 * | 5/2017 | Kochan, Jr. | E03B 5/02 |

OTHER PUBLICATIONS

WS Series Duples Control Panels Catalog as archived and printed May 10, 2017, in 2 pages. URL: https://web.archive.org/web/20170510192559/http://www.seewaterinc.com/product/single-phase-duplex-demand-wd1p-4.

Single Phase Duples Control Panel Installation and Operator's Manual as archived and printed May 10, 2017, in 2 pages. URL: https://web.archive.org/web/20170510192559/http://www.seewaterinc.com/product/single-phase-duplex-demand-wd1p-4.

Wiring Diagram as archived and printed May 10, 2017, in 3 pages. URL: https://web.archive.org/web/20170510192559/http://www.seewaterinc.com/product/single-phase-duplex-demand-wd1p-4.

* cited by examiner

ELECTRONIC SYSTEMS FOR CONTROLLING SUBMERSIBLE PUMPS

BACKGROUND

Field

Embodiments of the invention relate to electronic systems, and in particular, to control circuits for submersible pumps.

Description of the Related Technology

Submersible pumps for pumping fluids from a reservoir can be used in a wide variety of applications.

For instance, submersible pumps can be used for pumping waste water in sewage pump chambers, grinder pumps, sump pump basins, and/or lift stations. In another example, submersible pumps can be used to remove water accumulating in enclosed spaces, such as transformer vaults or elevator shafts, used to house technological infrastructure, such as electronics and/or hydraulics. The infrastructure can be enclosed for various reasons, such as engineering design, theft prevention, noise dampening, and/or aesthetics. However, such enclosed spaces are often subject to fluid accumulation arising from rain, irrigation, leaks, and/or other sources.

SUMMARY

In one aspect, an electronically controlled pump system is provided. The electronically controlled pump system includes three or more pumps configured to pump fluid from a reservoir, a plurality of sensors configured to generate a plurality of sense signals indicating a fluid level of the reservoir, and a control circuit comprising logic circuitry configured to individually control activation of the three or more pumps based on the plurality of sense signals so as to control pumping of fluid from the reservoir and a switching power supply circuit configured to convert an AC input voltage to a regulated DC voltage that powers the logic circuitry. The logic circuitry is operable in a plurality of user-selectable operating modes associated with different pump activation sequences in response to the fluid level of the reservoir rising, and the plurality of user-selectable operating modes includes a standard mode in which the control circuit is configured to operate the three or more pumps as a lead pump, a lag pump, and a lag/lag pump, and a jockey mode in which the control circuit is configured to operate the three or more pumps as a jockey pump, a first auxiliary pump, and a second auxiliary pump. In the standard mode, the control circuit is configured to activate the lead pump in response to the fluid level reaching a first fluid level, to activate the lead pump and the lag pump in response to the fluid level reaching a second fluid level above the first fluid level, and to activate the lead pump, the lag pump and the lag/lag pump in response to the fluid level reaching a third fluid level above the second fluid level. In the jockey mode, the control circuit is configured to activate the jockey pump in response to the fluid level reaching the first fluid level, to turn off the jockey pump and activate the first auxiliary pump in response to the fluid level reaching the second fluid level, and to turn on the first auxiliary pump and the second auxiliary pump while maintaining the jockey pump off in response to the fluid level reaching the third fluid level. The logic circuitry is further operable to rotate selection of at least a portion of the three or more pumps over time to reduce pump wear.

In another aspect, a pump control panel for a pump system is provided. The pump control panel includes a housing, three or more relays configured to control switching of three or more pumps that pump fluid from a reservoir, and a controller board in the housing. The controller board is configured to receive a plurality of sense signals indicating a fluid level of the reservoir, and to process the plurality of sense signals to generate a plurality of pump control signals operable to control the three or more relays to individually control activation of the three or more pumps.

In another aspect, a controller board for a pump system is provided. The controller board includes a sensor logic circuit configured to generate a pump run signal based on processing a plurality of sense signals indicating a fluid level of a reservoir, a pump selection logic circuit configured to generate a plurality of pump selection signals based on the pump run signal, and a pump relay driver circuit configured to process the plurality of pump selection signals to generate a plurality of pump drive signals operable to individually control activation of three or more pumps so as to control pumping of fluid from the reservoir.

In another aspect, an electronically controlled pump system is provided. The electronically controlled pump system includes three or more pumps configured to pump fluid from a reservoir, a plurality of sensors configured to generate a plurality of sense signals indicating a fluid level of the reservoir, and a control circuit configured to individually control activation of the three or more pumps based on the plurality of sense signals so as to control pumping of fluid from the reservoir.

DETAILED DESCRIPTION OF EMBODIMENTS

Figure 1:
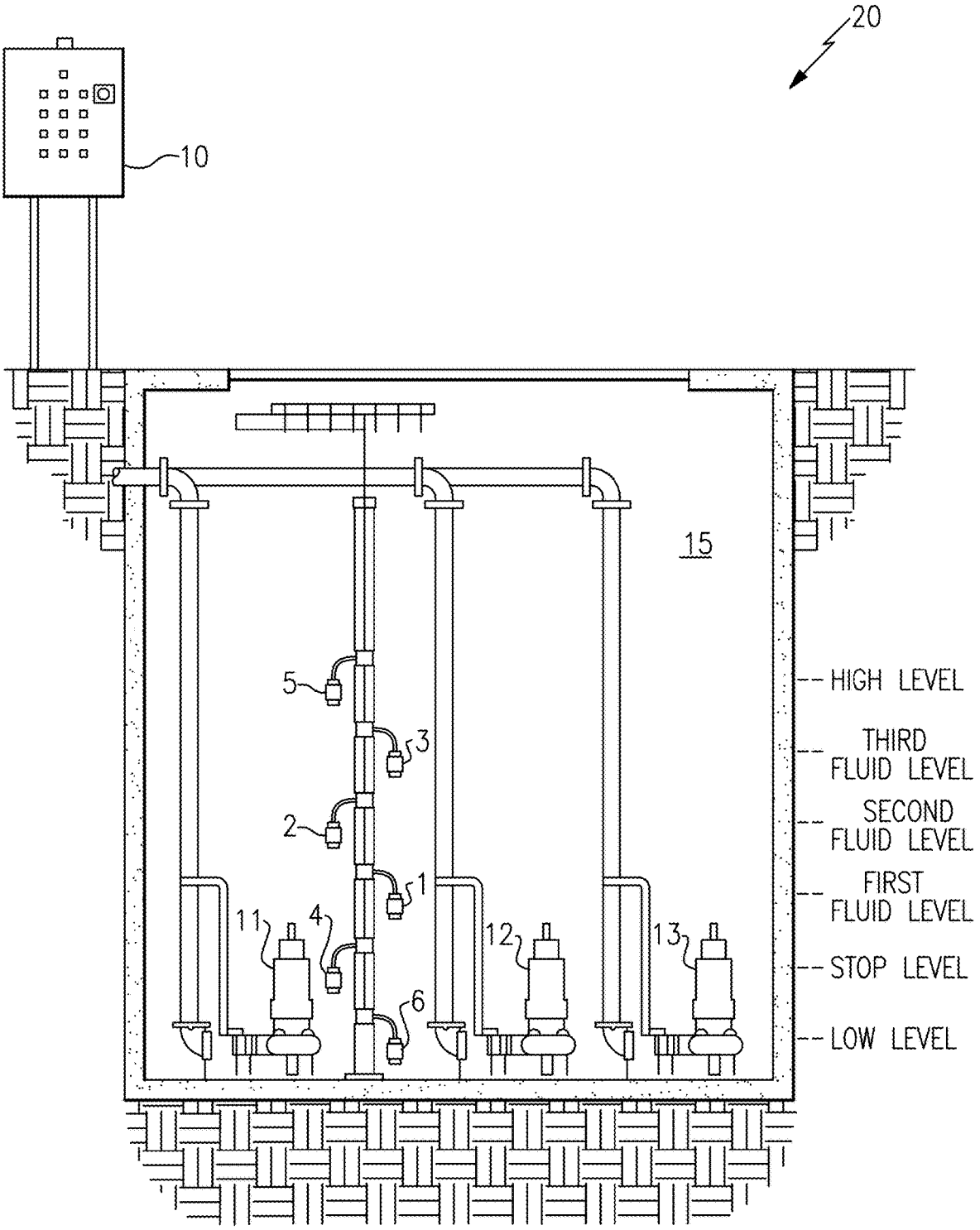
FIG. 1 is a schematic diagram of a pump system according to one embodiment.

The following detailed description presents various descriptions of specific embodiments. However, the innovations described herein can be embodied in a multitude of different ways, for example, as defined and covered by the claims. In this description, reference is made to the drawings where like reference numerals can indicate identical or functionally similar elements. It will be understood that elements illustrated in the figures are not necessarily drawn to scale. Moreover, it will be understood that certain embodiments can include more elements than illustrated in a drawing and/or a subset of the elements illustrated in a drawing. Further, some embodiments can incorporate any suitable combination of features from two or more drawings.

Electronic systems for controlling submersible pumps are provided herein. In certain configurations, a pump system includes three or more submersible pumps used for pumping fluid from a reservoir, sensors used for generating sense signals indicating a fluid level of the reservoir, and a control circuit for selectively activating the pumps based on the sense signals so as to control pumping of fluids from the reservoir.

The pumps are individually activated by the control circuit based on the fluid level indicated by the sense signals. For example, the sense signals generated by the sensors indicate whether the fluid level of the reservoir has reached various levels or positions.

In certain configurations, the control circuit is operable in a selected operating mode chosen from multiple operating modes including a standard or triplex mode and a jockey mode. The operating modes are associated with different pump activation sequences in response to the fluid level of the reservoir rising, and the operating mode is user-selectable to provide pumping control suitable for a particular application.

When operating in the standard mode, a first pump operates as a lead pump, a second pump operates as a lag pump, and a third pump operates as a lag/lag pump. Additionally, the control circuit sequentially activates the lead pump, the lag pump, and the lag/lag pump in response to rising fluid levels. In certain implementations, the control circuit is implemented to rotate or otherwise change which particular pumps are selected as lead pump, lag pump, and lag/lag pump over time to reduce pump wear.

In one example, when the fluid level reaches a first fluid level, the control circuit activates the lead pump. When the pumping provided by the lead pump is sufficient to lower the fluid to a stop level, the control circuit deactivates the lead pump. However, if the fluid level continues to rise such that the fluid reaches a second fluid level, the control circuit further activates the lag pump while the lead pump continues pumping. The control circuit deactivates the lead pump and lag pump if the combined pumping is sufficient to lower the fluid level to the stop level. However, if the fluid level continues to rise such that the fluid reaches a third fluid level, the control circuit further activates the lag/lag pump while the lead pump and the lag pump continue to operate.

In certain implementations, the sensors also detect for fluid exceeding a high level indicating an overflow condition of the reservoir and/or fluid falling below a low level indicating that undesirably low liquid levels have been reached. For instance, implementing the sensors to detect for a low fluid level can be desirable in implementations in which the pumps are designed for submersion, and can dry out and become damaged when the fluid level is too low.

When operating in the jockey mode, a jockey pump is activated by the control circuit in response to fluid reaching the first fluid level. The jockey pump is deactivated by the control circuit in response to the fluid lowering to the stop level. However, if fluid levels continue to rise such that fluid reaches the second fluid level, the control circuit turns off the jockey pump and turns on a first auxiliary pump. If fluid levels further rise such that the fluid reaches the third fluid level, the control circuit further turns on a second auxiliary pump such that the first and second auxiliary pumps both provide pumping while the jockey pump remains off. In certain implementations, the control circuit is implemented to rotate or otherwise change which particular auxiliary pumps are selected as the first auxiliary pump and the second auxiliary pump such that the order that the auxiliary pumps are activated is changed over time to reduce pump wear.

The auxiliary pumps can be of larger size and/or higher pumping capacity relative to the jockey pump. In certain configurations, the control circuit is implemented with a timer circuit that operates to intermittently activate a particular auxiliary pump. Including the timer circuit aids in occasionally exercising the auxiliary pumps to prevent the auxiliary pumps from drying out and/or otherwise being damaged from lack of use.

In certain implementations, the control circuit is implemented as a controller board, such as a printed circuit board (PCB) that is housed in a pump control panel of the pump system.

In addition to the control circuit, the pump control panel includes other electronic circuitry and/or components for receiving user inputs, providing status, and/or controlling the pump system. For example, in certain implementations the pump control panel includes relays controlled by the control circuit and used to selectively activate the pumps.

In certain implementations, the control circuit receives fault indication signals associated with the pumps, which are processed by the control circuit to activate user alert indicators and/or to control pump selection. For example, the fault indication signals can include temperature fault signals indicating whether or not a particular pump has overheated and/or breaker fault signals indicating whether or not a breaker is open for a particular pump. When a particular pump has an activated fault indication signal, the control circuit can alert the user and avoid activating the pump.

The control circuit can notify an end user of status or functioning of a pump system in a variety of ways, including, for example, by controlling a visual indicator such as a light, by controlling an audio indicator such as a buzzer, and/or by sending an electronic notification. In one example, a control circuit controls a visual indicator such as a light-emitting diode that is visible from outside the pump control panel to notify an end user of the status of the pump system without needing to open the pump control panel. In another example, a control circuit activates an audio indicator such as a buzzer that can be heard by an end user at a relatively far distance from the pump control panel. In yet another example, the control circuit generates an electronic notification to an end user, such as by sending an electronic message over a wired or wireless network to a user device, such as computer, tablet, or mobile phone.

In certain implementations, the control circuit includes a switching power supply circuit for generating a regulated DC voltage from an AC supply voltage. The regulated DC voltage is used in part to power logic circuitry of the control circuit.

By implementing the control circuit in this manner, flexibility is enhanced by allowing circuitry to receive power from a wide range of AC supply voltages associated with various applications. In certain implementations, the control circuit includes a battery back-up input terminal configured to receive a battery back-up voltage to provide power when the AC supply voltage is not present.

In certain implementations, the control circuit operates without any microprocessor or microcontroller. For example, in one embodiment, the control circuit does not include a programmable logic controller (PLC).

Although microprocessors and microcontrollers can provide a wide range of logic functionality and control, microprocessors and microcontrollers operate using software or programming that can be inadvertently erased, which can lead to the pump system going offline and resulting in damage to the pump system and/or a need for intervention of a technician in the field. Furthermore, a printed circuit board (PCB) for a microprocessor or microcontroller can be relatively large, which can result in an undesirable increase in the size of a pump control panel for housing the PCB.

Large pump control panels can have high cost and/or may be infeasible to install in applications associated with small spaces.

FIG. 1 is a schematic diagram of a pump system 20 according to one embodiment. The pump system 20 includes sensors 1-6, which generate sense signals indicating a detected fluid level of a reservoir 15. The pump system 20 further includes a pump control panel 10 and submersible pumps 11-13, which are positioned in the reservoir 15 and are individually activated by a control circuit housed in the pump control panel 10.

The pump system 20 can correspond to pump systems associated with a wide variety of applications, including, but not limited to, sewage pump chambers, grinder pump systems, sump pump basins, and/or lift stations.

Although an implementation with three submersible pumps is shown, the teachings herein are applicable to pump systems including four or more pumps.

In the illustrated embodiment, the sensors 1-6 are implemented as float switches that operate to detect a fluid level of the reservoir 15. The sensors 1-6 generate sense signals, which are provided to the pump control panel 10 for processing.

The pump control panel 10 can process signals from a wide variety of sensor types including, but not limited to, normally open (N/O) sensors, normally closed (N/C) sensors, or a combination thereof. Although an implementation using float switches is shown, a wide variety of types of sensors can be used in accordance with the teachings herein. Furthermore, although an implementation with six sensors is shown, the teachings herein are applicable to pump systems including more or fewer sensors and/or different arrangements of sensors.

As shown in FIG. 1, a first or lead sensor 1 detects when the fluid level reaches a first fluid level, a second or lag sensor 2 detects when the fluid level reaches a second fluid level, a third or lag/lag sensor 3 detects when the fluid level reaches a third fluid level, and a stop sensor 4 detects when the fluid level falls to a stop level in which pumping should be stopped.

The pump system 20 of FIG. 1 further includes a high level sensor 5 that detects when the fluid level exceeds a high level. In certain implementations, the pump control panel's control circuit activates a high liquid alarm or other user notification in response to the high level sensor 5 detecting the high level condition. Implementing the pump system 20 in this manner can aid in alerting an end user when the pumps 11-13 are unable to lower the fluid level of the reservoir 15 and overflow is imminent.

The illustrated embodiment further includes a low level sensor 6 that detects when the fluid level is too far below the stop level. Implementing a pump system's sensors to detect for low fluid level can be desirable in implementations in which one or more of the pumps are designed for continuous submersion, and can dry out and become damaged when liquid is not present or too low. In certain implementations, the control circuit of the pump control panel 10 activates a low liquid alarm or other user notification in response to the low level sensor 6 detecting low fluid level.

The submersible pumps 11-13 can be implemented in a wide variety of ways, such as using motorized pumps that are remotely controlled by relays housed in the control panel 10. In certain implementations, the submersible pumps 11-13 correspond to sewage dewatering pumps including dry motors and/or submersible motors that operate in water.

In certain implementations, the pump control panel's control circuit processes fault indication signals associated with the submersible pumps 11-13 to activate user alert indicators and/or to control pump selection. For example, the fault indication signals can include temperature fault signals indicating whether or not one or more of the pumps 11-13 has overheated and/or breaker fault signals indicating whether or not a breaker is open for one or more of the pumps 11-13.

When a particular pump has an activated fault indication signal, the control circuit in the pump control panel 10 can alert the end user and/or avoid activating the pump. The pump control panel's control circuit can alert an end user of a fault in a wide variety of ways, including, but not limited to, by controlling a visual indicator such as a light, by controlling an audio indicator such as an alarm bell, and/or by sending an electronic notification.

In certain implementations, the pumps 11-13 include temperature sensors that provide temperature fault indication signals to the pump control panel 10. In one example, the pumps 11-13 include thermal cut-out pump protectors that monitor the temperature of a corresponding pump, and shut off the current to the pump when the pump has overheated. Additionally, the thermal cut-out pump protectors provide temperature fault indication signals to the pump control panel 10 such that the pump control panel's control circuit is notified of the fault.

The control circuit of the pump control panel 10 individually activates the pumps 11-13 based on the fluid level indicated by the sense signals from the sensors 1-6. In certain implementations, the control circuit is operable in a selected operating mode chosen from multiple operating modes including a standard or triplex mode and a jockey mode. The operating mode can be selected by the end user, thereby providing control over pumping suitable for a particular application.

When operating in the standard mode, a first pump is operated as a lead pump, a second pump is operated as a lag pump, and a third pump is operated as a lag/lag pump. Additionally, the control circuit sequentially activates the lead pump, the lag pump, and the lag/lag pump in response to rising fluid levels.

For example, the control circuit can activate the lead pump in response to the fluid level of the reservoir 15 reaching the first fluid level. When the pumping provided by the lead pump is sufficient to lower the fluid to the stop level, the control circuit deactivates the lead pump. However, if the fluid level continues to rise such that the fluid reaches the second fluid level, the control circuit further activates the lag pump while the lead pump continues pumping. The control circuit deactivates the lead pump and the lag pump if the combined pumping is sufficient to lower the fluid level to the stop level. However, if the fluid level continues to rise such that the fluid reaches a third fluid level, the control circuit further activates the lag/lag pump while the lead pump and the lag pump continue to pump. When the fluid level is lowered to the stop level, the control circuit turns off the lead pump, the lag pump, and the lag/lag pump.

In certain implementations, the control circuit of the pump control panel 10 is implemented to rotate or otherwise change which of the pumps 11-13 are selected as lead pump, lag pump, and lag/lag pump over time to reduce pump wear.

In one example, during a first time interval the pumps 11-13 correspond to a lead pump, a lag pump, and a lag/lag pump, respectively, during a second time interval the pumps 11-13 correspond to a lag pump, a lag/lag pump, and a lead pump, respectively, and during a third time interval the pumps 11-13 correspond to a lag/lag pump, a lead pump, and a lag pump, respectively. Although one example of a rotation sequence has been described, other implementations are possible.

When operating in the jockey mode, a particular pump serves as a jockey pump that is activated by the pump control panel's control circuit in response to fluid reaching the first fluid level. The jockey pump is deactivated by the control circuit when fluid reaches the stop level. However, if fluid levels continue to rise such that fluid reaches the second fluid level, the control circuit turns off the jockey pump and turns on a first auxiliary pump. If fluid levels further rise such that the fluid reaches the third fluid level, the control circuit further turns on a second auxiliary pump such that the first and second auxiliary pumps both provide pumping while the jockey pump remains off. When the fluid level is lowered to the stop level, the control circuit turns off the auxiliary pumps.

Although FIG. 1 illustrates the pumps 11-13 as being substantially identical, in certain implementations the pumps can be different from one another. For example, in applications using the jockey mode, the auxiliary pumps can be of larger size and/or higher pumping capacity relative to the jockey pump.

In certain implementations, the control circuit is implemented to rotate or otherwise change which pumps are designated as the first auxiliary pump and the second auxiliary pump such that the order that the auxiliary pumps are activated is changed over time to reduce pump wear. The control circuit can also include a timer circuit that operates to intermittently activate a particular auxiliary pump. Including the timer circuit aids in occasionally operating the auxiliary pumps to prevent the pumps from drying out and/or otherwise being damaged from lack of use.

Although described in the context of operating modes that control three pumps, the teachings herein are also applicable to pump systems for controlling four or more pumps.

The pump system 20 can operate with a range of power supply voltages associated with various applications. In certain implementations, the control circuit of the pump control panel 10 includes a switching power supply circuit for generating a regulated DC voltage from an AC supply voltage. The regulated DC voltage is used to power logic circuitry that controls activation of the pumps 11-13.

By including a switching power supply circuit, flexibility is enhanced. For example, the pumps 11 can be powered using 208 volts AC power (VAC), 240 VAC, 480 VAC, and/or any other suitable power source based on application and/or implementation. Accordingly, inclusion of the switching power supply circuit in the pump control panel 10 enhances flexibility by allowing the pump system 20 to operate using a wide range of power supplies. In certain implementations, the control circuit includes a battery back-up input terminal configured to receive a battery back-up voltage to provide power when the AC supply voltage is not present.

Figure 2A:
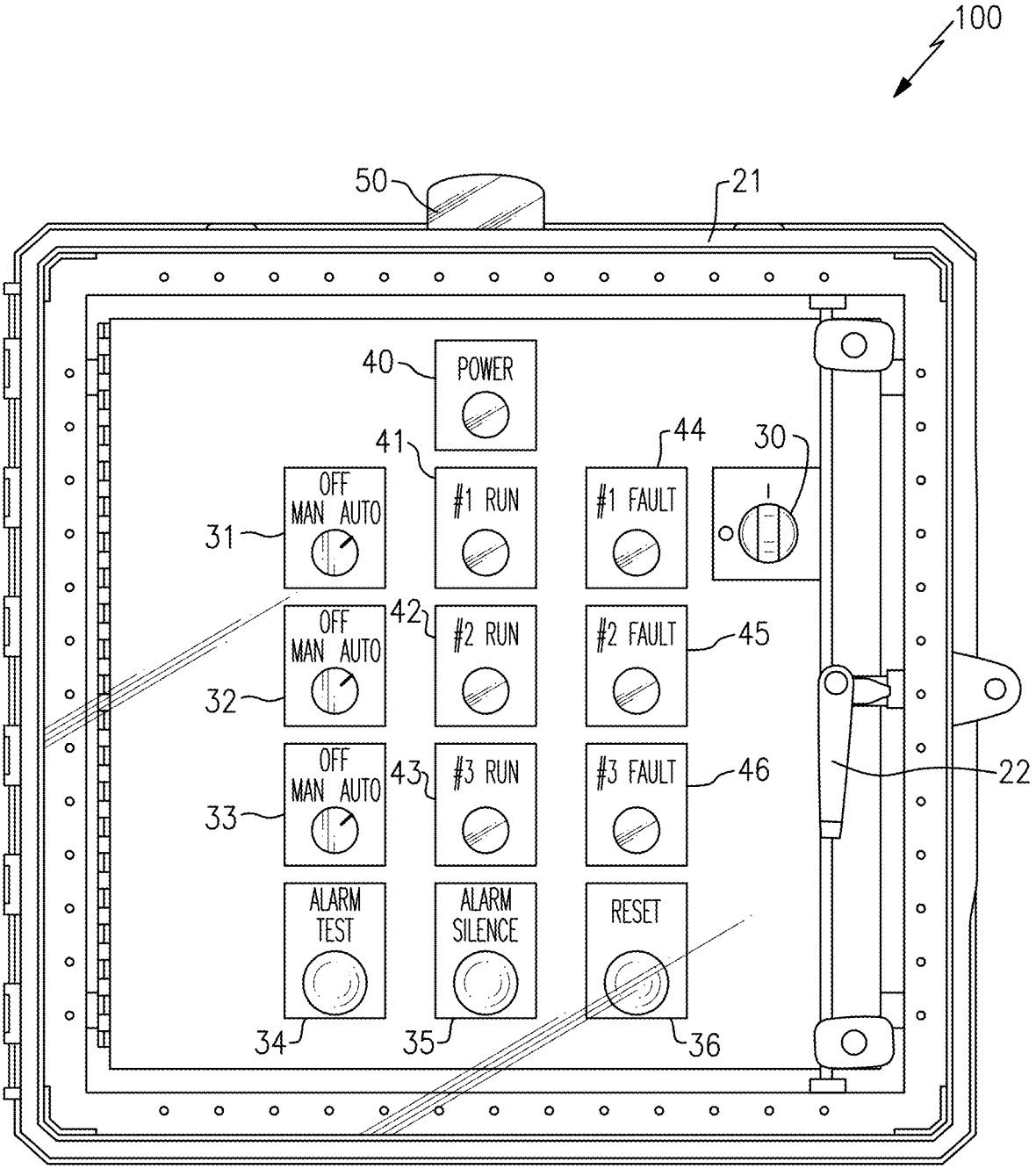
FIG. 2A is a frontal view of one embodiment of a pump control panel with a front door closed.
Figure 2B:
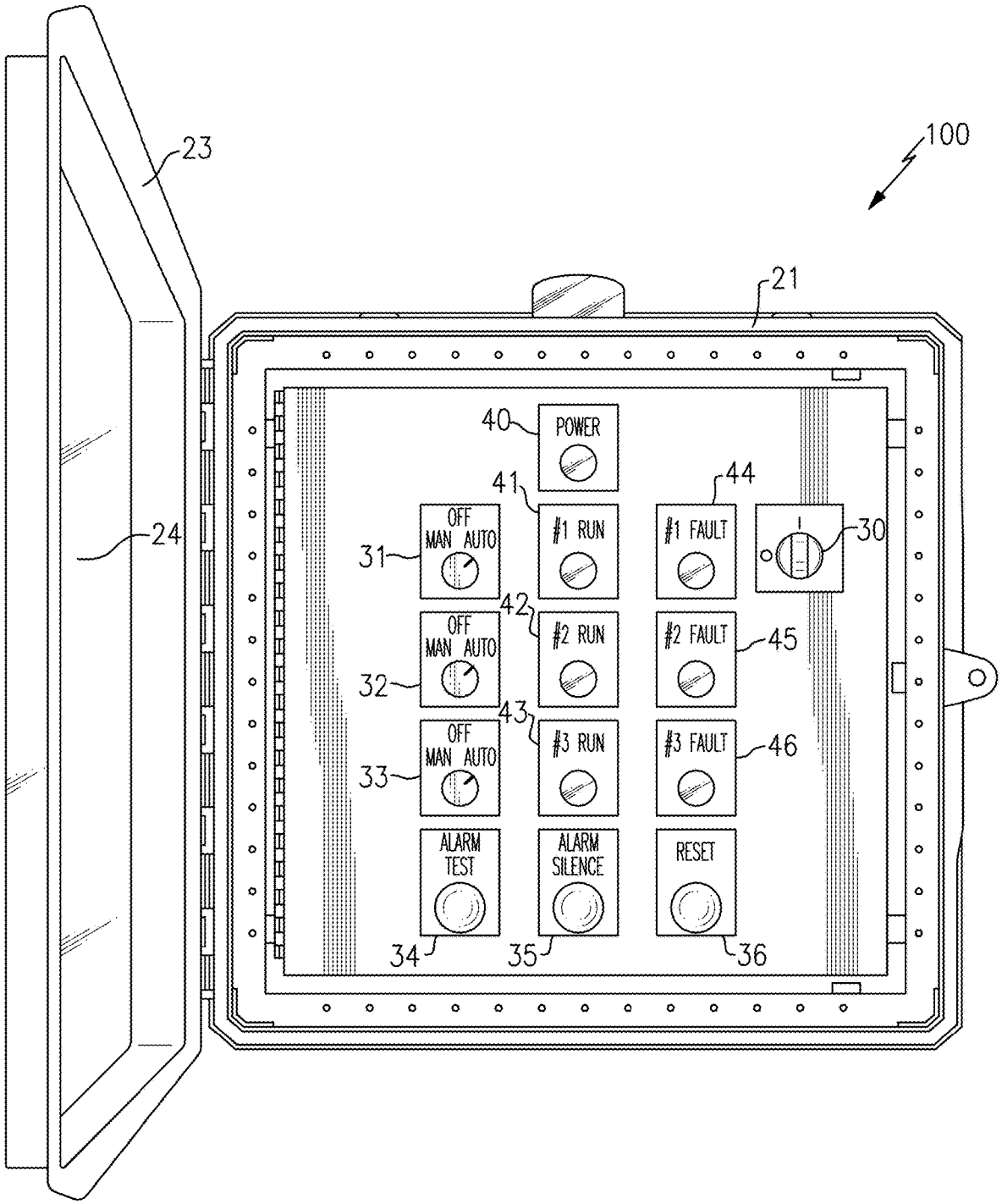
FIG. 2B is a frontal view of the pump control panel of FIG. 2A with the front door open.

FIG. 2A is a frontal view of one embodiment of a pump control panel 100 with a front door closed. FIG. 2B is a frontal view of the pump control panel 100 of FIG. 2A with the front door open.

The pump control panel 100 illustrates one embodiment of a pump control panel suitable for use in a pump system, such as the pump system 20 of FIG. 1. However, the teachings herein are applicable to pump control panels implemented in a wide variety of ways as well as to other implementations of pump systems.

For example, pump control panels can be implemented with various form factors and using a wide variety of components and circuitry. Furthermore, a pump control panel can receive user inputs and/or provide user notifications in a wide variety of ways. Accordingly, although one embodiment of a pump control panel is shown, other implementations are possible.

In the illustrated embodiment, the pump control panel 100 includes a housing 21, a latch 22, a front door 23, a main power switch 30, a first pump control switch 31, a second pump control switch 32, a third pump control switch 33, an alarm test button 34, an alarm silence button 35, a reset button 36, a power on light 40, a first pump run light 41, a second pump run light 42, a third pump run light 43, a first pump fault light 44, a second pump fault light 45, a third pump fault light 46, and an alarm light 50.

In the illustrated embodiment, the housing 21 is used to house electronic circuitry and components of the pump control panel 100. The housing 21 can be implemented using a wide variety of materials, including, but not limited to, metal (for instance, stainless steel), plastic (for instance, fiberglass), and/or polymers (for instance, polycarbonate). In certain implementations, the housing 21 is implemented in compliance with a National Electrical Manufacturers Association (NEMA) Type 4X enclosure. Implementing the housing 21 in this manner can provide consumer protection against access to high voltage electronics while also protecting internal electronic circuitry and components from dust, water, and/or corrosion. However, other implementations are possible.

With continuing reference to FIGS. 2A-2B, the front door 23 includes a cover 24, which is clear, in this embodiment. Implementing the front door 23 with a clear cover can aid in providing user visibility to indicator lights without needing to open the front door 23. As shown in FIG. 2A, the front door 23 is secured to the housing 21 via the latch 22, which is implemented as a three-point locking latch, in this embodiment. The front door 23 further includes a padlock attachment for allowing an end user to lock the front door 23 via a padlock to inhibit unauthorized access to the pump control panel 100.

The main power switch 30 is used to turn or off the control panel 100, and serves as a main disconnect. Thus, an end user can turn on or off AC power to the system via the main power switch 30.

The illustrated control panel 100 includes the first pump control switch 31, the second pump control switch 32, and the third pump control switch 33, which are implemented as hand-off-auto selector switches, in this embodiment. The pump control switches 31-33 can be used to control corresponding submersible pumps. For example, when the control panel 100 is used in the pump system 20 of FIG. 1, the first pump control switch 31 can be used to control the first submersible pump 11, the second pump control switch 32 can be used to control the second submersible pump 12, and the third pump control switch 33 can be used to control the third submersible pump 13.

When the pump control switches 31-33 are each set in the "AUTO" position, the pump control panel's control circuit controls activation of the pumps based on a selected operating mode, for instance, standard mode or jockey mode. However, when a particular control switch is set in the "OFF" position, the end user overrides the control circuit to turn off the corresponding pump. Additionally, when a particular pump control switch is turned to the "MAN" position, the end user overrides the control circuit to manually turn on the corresponding pump.

The first pump run light 41, the second pump run light 42, and the third pump run light 43 indicate when a particular pump is running. Additionally, the first pump fault light 44, the second pump fault light 45, and the third pump fault light 46 indicate when a particular pump is in a fault condition. For instance, a pump fault light associated with a particular pump can be activated when the pump has overheated and/or when a breaker is open for the pump. In certain implementations, the pump run lights 41-43 and the pump fault lights 44-46 are implemented using different colors, for instance, using green and red lights, respectively.

The pump control panel 100 further includes the power on light 40 for indicating when a power supply is present, and the alarm light 50 for indicating when an alarm condition is present, such as a high fluid level warning of imminent overflow and/or a low fluid level warning that a fluid level is too low. In certain implementations, the pump control panel 100 further includes an alarm bell attached to the housing 21, such as an alarm horn that sound at 85 decibels or louder at 10 feet.

In certain implementations, the pump control panel 100 is configured to provide one or more electronic notifications associated with a status of the pump control panel 100. In one example, the pump control panel 100 can include dry contacts for remote monitoring of low fluid level, high fluid level, running of the first pump, a fault of the first pump, running of the second pump, a fault of the second pump, running of the third pump, and/or a fault of the third pump. Additionally, any suitable dry contact sensor can be used to monitor the state of the dry contacts to generate a wide variety of electronic notifications pertaining to the status of the pump control panel 100, such as phone calls, text messages, and/or e-mails. In another example, the pump control panel 100 includes circuitry within or attached to the housing (for instance, a transceiver) for sending wired or wireless electronic notifications.

The illustrated control panel 100 further includes an alarm test button 34 for testing the alarm (for instance, the alarm light 50 and/or an alarm horn), and an alarm silence button 35 for stopping the alarm after testing. The control panel 100 further includes a reset button 36, which can be used by an end user to reset the state of logic circuitry associated with the pump control panel's control circuit. For example, the reset button 36 can be used to reset a pump rotation state associated with the standard mode, to reset an auxiliary pump rotation state associated with the jockey mode, and/or to reset a timer associated with occasionally exercising the auxiliary pumps in the jockey mode.

Figure 3:
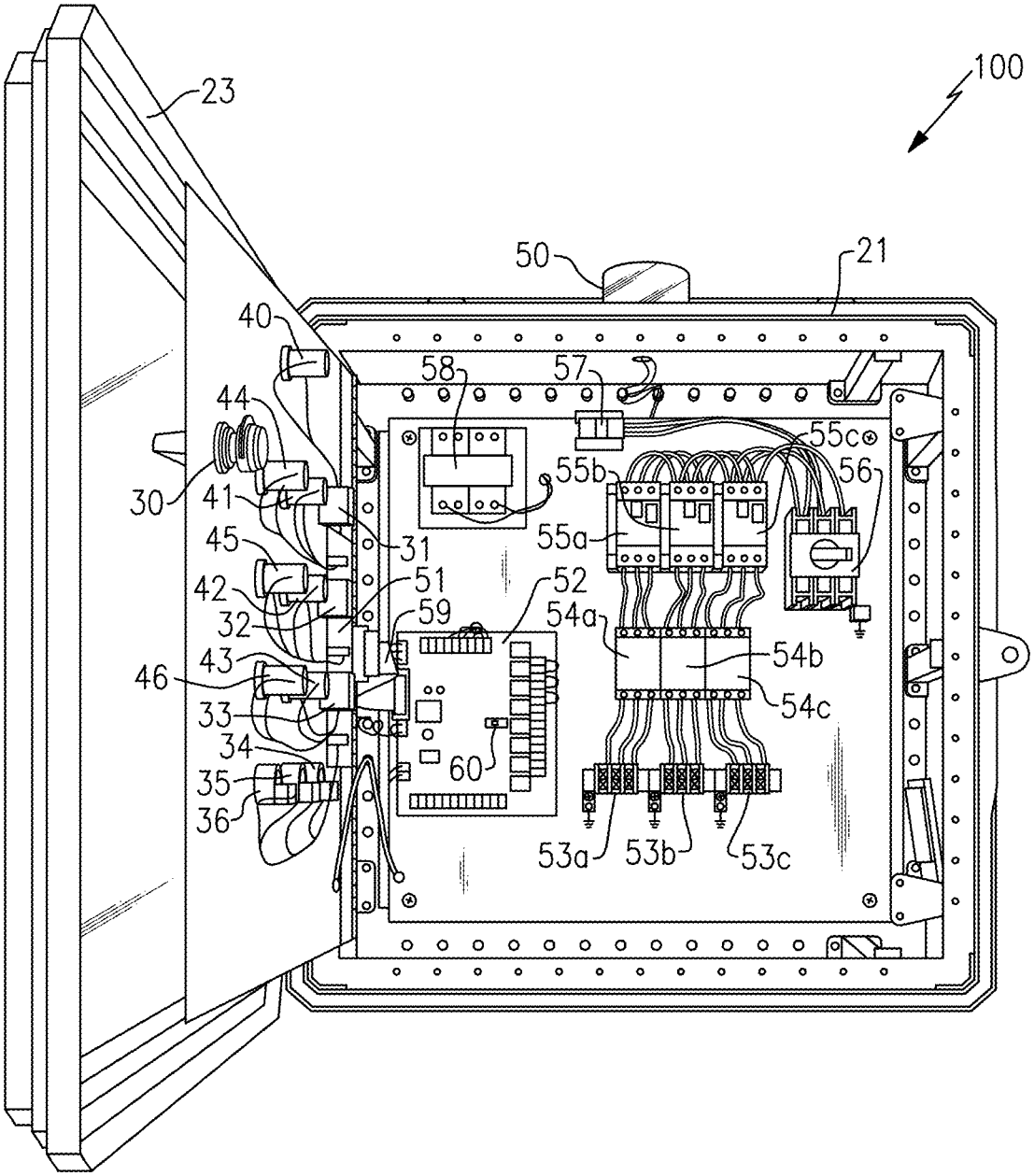
FIG. 3 is a frontal view of an interior of the pump control panel of FIGS. 2A-2B.

FIG. 3 is a frontal view of an interior of the pump control panel 100 of FIGS. 2A-2B. As shown in FIG. 3, the pump control panel 100 includes the housing 21, the front door 23, the main power switch 30, the first pump control switch 31, the second pump control switch 32, the third pump control switch 33, the alarm test button 34, the alarm silence button 35, the reset button 36, the power on light 40, the first pump run light 41, the second pump run light 42, the third pump run light 43, the first pump fault light 44, the second pump fault light 45, the third pump fault light 46, and the alarm light 50, which were described earlier with respect to FIGS. 2A-2B.

The pump control panel 100 further includes a front panel board 51, a controller board 52, first pump AC power terminal strips 53*a*, second pump AC power terminal strips 53*b*, third pump AC power terminal strips 53*c*, a first pump relay 54*a*, a second pump relay 54*b*, a third pump relay 54*c*, first pump circuit breakers 55*a*, second pump circuit breakers 55*b*, third pump circuit breakers 55*c*, main disconnect and AC power terminal strips 56, controller AC power terminal strips 57, a multi-tap transformer 58, and a ribbon cable 59.

The first to third pump AC power terminal strips 53*a*-53*c* are used for providing AC power to first to third pumps, respectively. Additionally, the first to third pump relays 54*a*-54*c* switch AC power to the first to third pumps, respectively. The controller board 52 generates pump control signals for the pump relays 54*a*-54*c*, thereby controlling or commanding whether or not a particular pump is activated. In the illustrated embodiment, the controller board 52 is implemented using circuit components attached to a PCB. In certain implementations, the PCB is less than 50 square inches. However, other implementations are possible.

In the illustrated embodiment, the first to third pump circuit breakers 55*a*-55*c* provide branch protection to the first to third pumps, respectively, by stopping an excessive flow of current as a safety measure. In certain implementations, the pump circuit breakers are controllable to provide adjustable overload and disconnect. In one example, a current at which the breakers open can be user-selected to a value suitable for the pumps used in a particular pump system. In certain implementations, the first to third pump circuit breakers 55*a*-55*c* provide the controller board 52 with fault indication signals indicating whether or not a breaker is open for a particular pump. When a particular pump has an activated fault indication signal, the controller board 52 can alert the user and avoid activating the pump.

The main disconnect and AC power terminal strips 56 are used to control AC power (for instance, 3-phase AC input power) to the whole system. In certain implementations, the main power switch 30 operates in combination with the main disconnect and AC power terminal strips 56 as a through door main disconnect, thereby providing easy and flexible power supply control to the end user.

With continuing reference to FIG. 3, the controller AC power terminal strips 57 serve to provide power to the controller board 52. Additionally, the multi-tap transformer 58 operates to transform an AC power supply voltage to a transformed AC voltage suitable for use by the controller board 52. In one example, the multi-tap transformer 58 includes a primary winding including multiple taps for receiving different AC power supply voltages, such as 208 VAC, 240 VAC, or 480 VAC, and a secondary winding that outputs 120 VAC or another suitable transformed AC voltage. Additionally, the controller board 52 includes a switching power supply circuit that converts the 120 VAC to a suitable regulated DC voltage for powering logic circuitry, for instance, 12 VDC.

The illustrated pump panel 100 includes the front panel board 51. As shown in FIG. 3, the front panel board 51 is electrically coupled to lights, buttons, and switches associated with the front panel user interface. For example, the front panel board 51 is electrically coupled to the first pump control switch 31, the second pump control switch 32, the third pump control switch 33, the alarm test button 34, the alarm silence button 35, the reset button 36, the power on light 40, the first pump run light 41, the second pump run light 42, the third pump run light 43, the first pump fault light 44, the second pump fault light 45, and the third pump fault light 46. The front panel board 51 is also electrically coupled to the controller board 52 via the ribbon cable 59, in this embodiment.

Although the illustrated embodiment includes both the front panel board 51 and the controller board 52, other implementations are possible. For example, in another embodiment, the front panel board 51 is omitted in favor of connecting components associated with the user interface directly to the controller board 52.

The controller board 52 illustrates one implementation of a control circuit for selectively activating pumps based on sense signals to thereby control pumping. The controller board 52 can be implemented in accordance with one or more features of the present disclosure.

In the illustrated embodiment, the controller board 52 receives sense signals from sensors (for instance, the sensors 1-6 of FIG. 1). Additionally, the controller board 52 processes the sense signals to generate pump control signals for the pump relays 54*a*-54*c*, thereby controlling individual activation of the pumps (for instance, the pumps 11-13 of FIG. 1).

As shown in FIG. 3, the controller board 52 includes a mode selection switch 60, which is used to select an operating mode of the controller board 52. The selected operating mode is chosen from multiple operating modes including a standard mode and a jockey mode. The operating mode can be selected by the end user, thereby providing pumping control suitable for a particular application. Although the illustrated embodiment uses a mode selection switch on the controller board to provide mode selection, other implementations of mode selection are possible. In another example, a mode selector is included in the front panel user interface.

Figure 4:
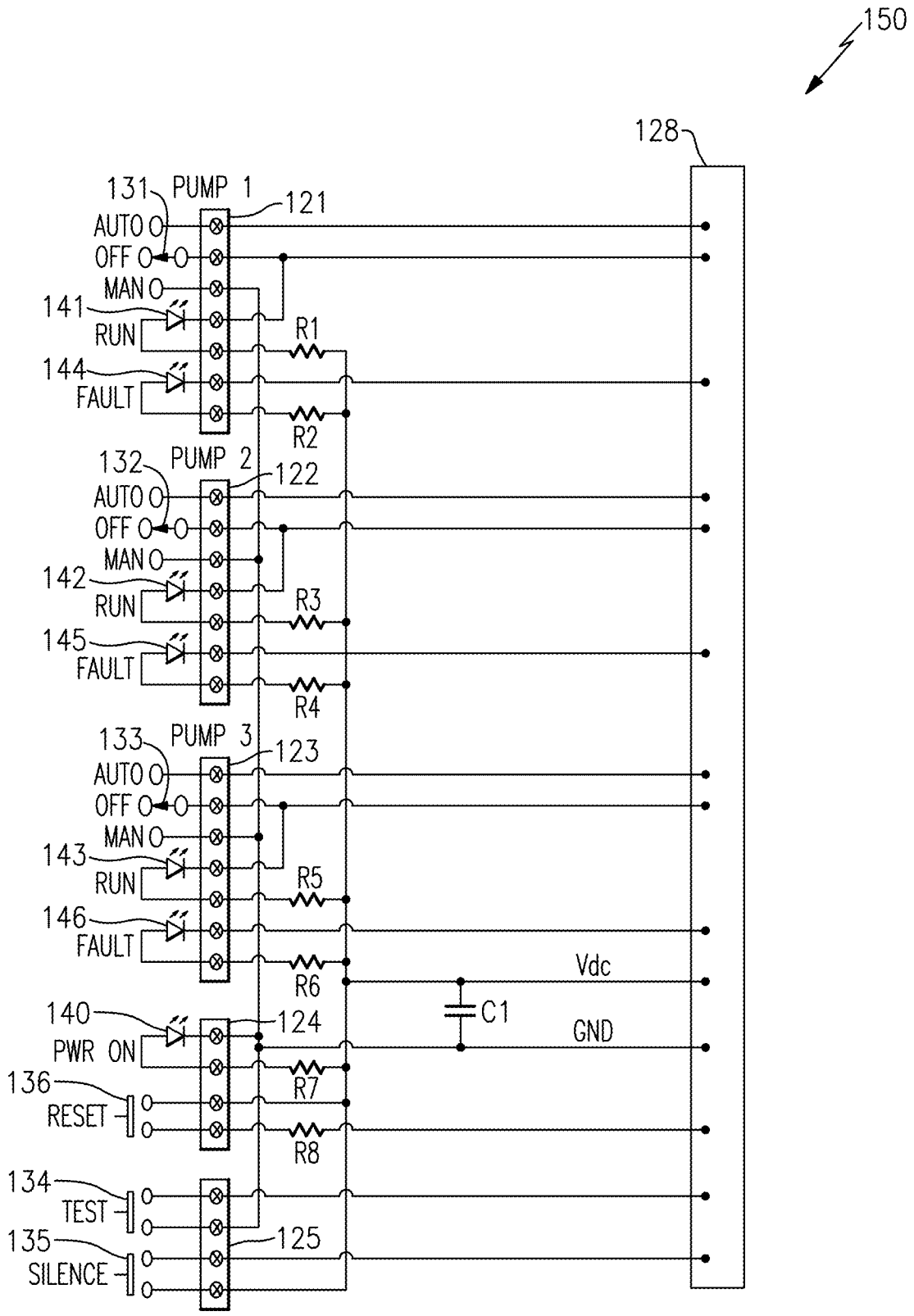
FIG. 4 is a schematic diagram of a front panel board according to one embodiment.

FIG. 4 is a schematic diagram of a front panel board 150 according to one embodiment. The front panel board 150 illustrates one embodiment of a front panel board suitable for a pump control panel, such as the pump control panel 100 of FIGS. 2A-3. However, the teachings herein are applicable to other implementations of front panel boards as well as to pump control panels implemented without front panel boards. For example, a front panel board can be omitted in favor of connecting components associated with a user interface directly to a controller board or other control circuit of a pump system.

In the illustrated embodiment, the front panel board 150 includes various input and output pins, including a first group of pins 121 associated with a user interface for the first pump, a second group of pins 122 associated with a user interface for the second pump, a third group of pins 123 associated with a user interface for the third pump, a fourth group of pins 124 associated with a power on light and reset button, and a fifth group of pins 125 associated with alarm test and silence buttons. The front panel board 150 further includes controller interface pins 128 for interfacing to a controller board (for example, the controller board 52 of FIG. 3) via a cable.

Various circuit elements have been shown in FIG. 4, including first to eighth resistors R1-R8, respectively, and capacitor C1. FIG. 4 also illustrates circuit elements corresponding to switches, lights, and buttons discussed earlier with respect to FIGS. 2A-3.

For example, the front panel board 150 includes switches 131-133 corresponding to the pump control switches 31-33, respectively, of the pump control panel 100 of FIGS. 2A-3. Additionally, the front panel board 150 includes a power on light-emitting diode (LED) 140 corresponding to the power on light 40, LEDs 141-143 corresponding to pump run lights 41-43, respectively, and LEDs 144-146 corresponding to pump fault lights 44-46, respectively. Furthermore, the front panel board 150 includes buttons 134-136, corresponding to the alarm test button 34, the alarm silence button 35, and the reset button 36, respectively.

The illustrated front panel board 150 receives a regulated DC supply voltage Vdc and a ground voltage GND from the controller board via the controller interface pins 128. As shown in FIG. 4, the capacitor C1 is used for power supply decoupling.

Figure 5:
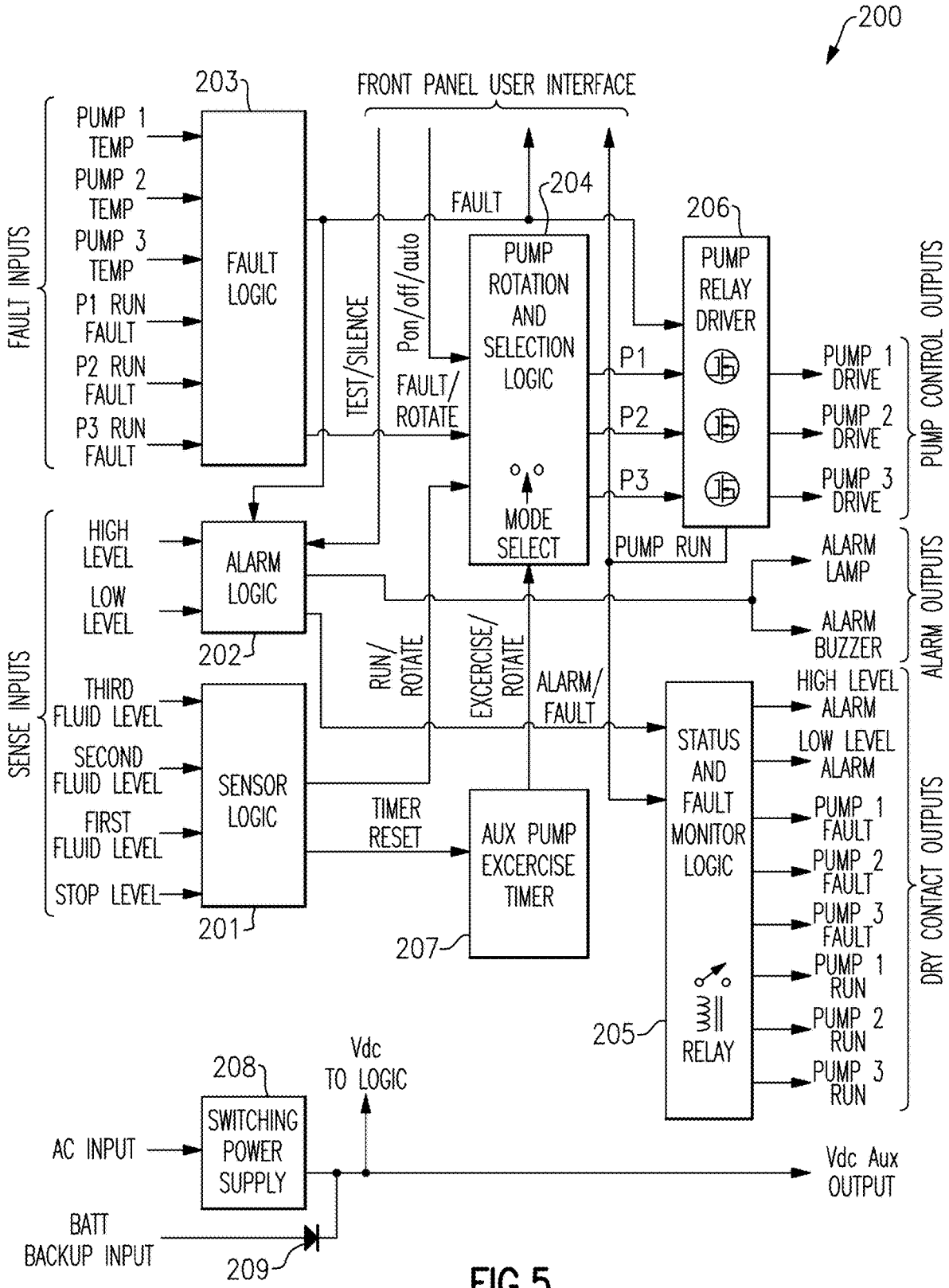
FIG. 5 is a schematic diagram of a controller board according to one embodiment.

FIG. 5 is a schematic diagram of a controller board 200 according to one embodiment. The controller board 200 includes a sensor logic circuit 201, an alarm logic circuit 202, a fault logic circuit 203, a pump rotation and selection logic circuit 204, a status and fault monitor logic circuit 205, a pump relay driver circuit 206, an auxiliary pump exercise timer 207, a switching power supply circuit 208, and a rectifier 209, which schematically depict groupings of components attached to a circuit board substrate.

The controller board 200 illustrates one embodiment of a controller board suitable for a pump control panel, such as the pump control panel 100 of FIGS. 2A-3. However, the teachings herein are applicable to other implementations of pump control circuits. Accordingly, other implementations are possible.

Although FIG. 5 schematically depicts signals using are lines, a signal can be carried using multiple conductors, such as when a signal is implemented differentially or when a signal is multi-bit.

The controller board 200 is used for controlling activation of pumps in a pump system. For example, in certain implementations herein, a pump system includes three or more submersible pumps used for pumping fluid from a reservoir, sensors used for generating sense signals indicating a fluid level of the reservoir, and a controller board housed in a pump control panel and operable to selectively activate the pumps based on the sense signals.

In the illustrated embodiment, the controller board 200 is operable in a selected operating mode chosen from multiple operating modes including a standard mode and a jockey mode. Additionally, a mode select signal indicating the selected mode is provided to the pump rotation and selection logic circuit 204.

As shown in FIG. 5 the sensor logic circuit 201 processes sense inputs indicating the fluid level relative to a first fluid level, a second fluid level, a third fluid level, and a stop level, in this embodiment. The sensor logic circuit 201 processes the sense inputs to generate a run/rotate signal, which is processed by the pump rotation and selection logic circuit 204 to determine which pumps should be selected for activation. The sensor logic circuit 201 also generates a timer reset signal, which will be discussed further below in connection with the auxiliary pump exercise timer 207.

In the illustrated embodiment, the fault logic circuit 203 receives temperature and breaker fault indication signals for the first pump, the second pump, and the third pump. The fault logic circuit 203 processes the fault indication signal to generate a fault/rotate signal, which is processed by the pump rotation and selection logic circuit 204 to determine which pumps should be selected for activation. In certain implementations, the pump rotation and selection logic circuit 204 changes pump selection from one pump (for instance, the first pump) to another pump (for instance, a second pump) when the fault/run signal indicates that a pump has faulted. Implementing the controller board 200 in this manner enhances the robustness of the pump system to faults, and allows the pump system to continue to run when at least one pump has not faulted.

The fault logic circuit 203 also generates a fault signal indicating whether or not each pump has overheated and whether or not a breaker is open for each pump. The fault signal is provided to the front panel user interface and to the alarm logic circuit 202 such that the user can be notified when a fault is present. In this example, the fault signal is also provided to the alarm logic circuit 202 to aid in alerting an end user and to the pump relay driver circuit 206 to ensure a faulted pump is not inadvertently activated.

As shown in FIG. 5, the alarm logic circuit 202 receives sense inputs indicating when fluid exceeds a high level indicating an overflow condition of the reservoir and/or fluid falling below a low level indicating that undesirably low liquid levels have been reached. Additionally, the alarm logic circuit 202 processes the high level sense input, the low level sense input, and the fault signal to determine when to activate alarm outputs (corresponding to an alarm lamp and an alarm buzzer, in this example). In the illustrated embodiment, the alarm logic circuit 202 receives alarm test and silence signals from the front panel user interface to aid the user in verifying that an alarm lamp, alarm buzzer, and/or other alarm is properly functioning.

In the illustrated embodiment, the alarm logic circuit 202 provides the status and fault monitor logic circuit 205 with an alarm/fault signal indicating the presence of an alarm condition and/or fault condition. The status and fault monitor logic circuit 205 also receives a pump run signal from the pump relay drivers 206 corresponding to the pumps that the pump relay driver circuit 206 has activated in response to a command from the pump rotation and selection logic circuit 204. The pump run signal is also provided to the front panel user interface to aid in alerting the user which pumps are running.

The status and fault monitor logic circuit 205 controls dry contact outputs, in this example, to aid in providing remote monitoring with respect to the status of the pump system. For instance, the status and fault monitor logic circuit 205 controls dry contact outputs associated with a high level alarm, a low level alarm, faulting of the first pump, faulting of the second pump, faulting of the third pump, running of the first pump, running of the second pump, and running of the third pump, in this example.

The dry contact outputs can be used for remote monitoring. In a first example, the dry contact outputs are used to control relays that activate remote notifications. In a second example, an end user uses a dry contact sensor to monitor the state of the dry contacts to generate any suitable electronic notification, such as phone calls, text messages, and/or e-mails. Although the illustrated embodiment provides remote monitoring via dry contacts, other implementations are possible. In another embodiment, a pump system includes circuitry (for instance, a transmitter or transceiver) for sending wired and/or wireless electronic notifications.

In the illustrated embodiment, the controller board 200 includes a switching power supply circuit 208 for generating a regulated DC voltage from an AC supply voltage. The regulated DC voltage is used to power logic circuitry of the controller board 200. In this example, the controller board 200 also provides a Vdc auxiliary output, which can be used to power a front panel board and/or other circuitry of a pump system.

The switching power supply circuit 208 receives an AC input voltage, which can be provided from a multi-tap transformer, in certain implementations. In one example, a multi-tap transformer includes a primary winding that can receive a variety of AC power supply voltages, such as 208 VAC, 240 VAC, or 480 VAC, and a secondary winding that outputs 120 VAC or another suitable transformed AC voltage. Additionally, the switching power supply circuit 208 converts the 120 VAC or other AC input voltage to a suitable regulated DC voltage for providing power to logic circuitry, for instance, 12 VDC. By implementing the controller board 200 in this manner, flexibility is enhanced by allowing circuitry to receive power from a wide range of AC supply voltages associated with various applications.

The switching power supply circuit 208 can be implemented in a wide variety of ways. In one example, the switching power supply circuit 208 includes a high-voltage switcher that provides switching over a range of frequencies including, for instance, at frequencies of 100 kHz or more. In one implementation, the high-voltage switcher is implemented using part NCP1077, available from ON Semiconductor of Phoenix, Ariz. In certain implementations, the switching power supply circuit 208 includes an input electromagnetic interface (EMI) filter, thereby providing rejection to unwanted noise.

As shown in FIG. 5, the controller board 200 includes a battery back-up input that receives a battery back-up voltage to provide power when the AC supply voltage is not present. Including the battery back-up aids in maintaining a user notified of status and alarm conditions when an AC power supply is disconnected or otherwise unavailable. In the example shown in FIG. 5, the battery back-up input is connected to the regulated voltage Vdc by way of the rectifier 209.

The pump rotation and selection logic circuit 204 generates a first pump selection signal P1, a second pump selection signal P2, and a third pump selection signal P3 for controlling activation of the pumps. In the illustrated embodiment, the pump selection signals are provided to the pump relay driver circuit 206, which drives relays corresponding to each of the pumps. However, other implementations are possible.

In the illustrated embodiment, the pump rotation and selection logic circuit 204 receives various inputs, including the run/rotate signal from the sensor logic circuit 201, the fault/rotate signal from the fault logic circuit 203, the exercise/rotate signal from the auxiliary pump exercise timer 207, pump control signals (Pon/off/auto) from the front panel user interface, and a mode select signal indicating whether the selected mode is the standard mode or the jockey mode.

In certain implementations, the pump control signals (Pon/off/auto) from the front panel user interface are received from hand/off/auto switches, such as the pump control switches 31-33 of FIGS. 2A-3. When each pump is in the "auto" position, the pump rotation and selection logic circuit 204 activates the pumps according to the selected operating mode, for instance, standard mode or jockey mode. However, the end user may set a pump to the "Pon" position to manually turn on a particular pump or to the "off" position to turn off a particular pump.

When operating in the standard mode, the pump rotation and selection logic circuit 204 selects a first pump to operate as a lead pump, a second pump to operate as a lag pump, and a third pump to operate as a lag/lag pump. Additionally, the pump rotation and selection logic circuit 204 rotates or changes which particular pumps are selected as lead pump, lag pump, and lag/lag pump over time to reduce pump wear.

The pump rotation and selection logic circuit 204 sequentially activates the lead pump, the lag pump, and the lag/lag pump in response to rising fluid levels in the standard mode. For example, the pump rotation and selection logic circuit 204 processes the run/rotate signal from the sensor logic circuit 201 to determine the pumps to selected based on the fluid level. Additionally, when the fluid level has reached the first fluid level, the pump rotation and selection logic circuit 204 activates the lead pump. When the pumping provided by the lead pump is sufficient to lower the fluid to the stop level, the pump rotation and selection logic circuit 204 deactivates the lead pump. However, if the fluid level continues to rise such that the fluid reaches a second fluid level, the pump rotation and selection logic circuit 204 further activates the lag pump while the lead pump continues pumping. The pump rotation and selection logic circuit 204 deactivates the lead pump and lag pump if the combined pumping is sufficient to lower the fluid level to the stop level. However, if the fluid level continues to rise such that the fluid reaches a third fluid level, the pump rotation and selection logic circuit 204 further activates the lag/lag pump while the lead pump and the lag pump continue to operate.

When operating in the jockey mode, the pump rotation and selection logic circuit 204 activates a jockey pump (corresponding to the first pump, in this embodiment) in response to fluid reaching the first fluid level. The jockey pump is deactivated by the pump rotation and selection logic circuit 204 in response to the fluid lowering to the stop level. However, if fluid levels continue to rise such that fluid reaches the second fluid level, the pump rotation and selection logic circuit 204 turns off the jockey pump and turns on a first auxiliary pump. If fluid levels further rise such that the fluid reaches the third fluid level, the pump rotation and selection logic circuit 204 further turns on a second auxiliary pump such that the first and second auxiliary pumps both provide pumping while the jockey pump remains off. In the illustrated embodiment, the pump rotation and selection logic circuit 204 is implemented to rotate or otherwise change which particular auxiliary pumps are selected as the first auxiliary pump and the second auxiliary pump such that the order that the auxiliary pumps are activated is changed over time to reduce pump wear.

The illustrated controller board 200 also includes the auxiliary pump exercise timer 207, which generates an exercise/rotate signal for intermittently activating an auxiliary pump. The auxiliary pump exercise timer 207 serves to exercise the auxiliary pumps to prevent the auxiliary pumps from drying out and/or otherwise becoming damaged from lack of use. For example, when the auxiliary pump exercise timer 207 activates the exercise/rotate signal, the pump rotation and selection logic circuit 204 can activate a selected auxiliary pump for a cycle rather than the jockey in response to fluid reaching the first fluid level. After the cycle completes, the sensor logic circuit 201 can reset the auxiliary pump exercise timer 207 via the timer reset signal. The auxiliary pump selected for exercising can be rotated or otherwise changed over time.

In certain implementations, the controller board 200 operates without any microprocessor or microcontroller. For example, in one embodiment, the controller board 200 does not include a programmable logic controller (PLC).

Although microprocessors and microcontrollers can provide a wide range of logic functionality and control, microprocessors and microcontrollers operate using software that can be inadvertently deprogrammed, which can lead to the pump system going offline and resulting in damage to the pump system and/or a need for intervention of a technician in the field. Furthermore, a printed circuit board (PCB) for a microprocessor or microcontroller can be relatively large, which can result in an undesirable increase in the size of a pump control panel for housing the PCB. Large pump control panels can have high cost and/or may be infeasible to install in applications associated with small spaces.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the word "connected", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list.

Moreover, conditional language used herein, such as, among others, "can," "could," "might," "can," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize.

The teachings of the invention provided herein can be applied to other systems and methods, not necessarily the systems and methods described above. The elements and acts of the various embodiments described above can be combined to provide further embodiments.

While certain embodiments of the inventions have been described, these embodiments have been presented by way of example only, and are not intended to limit the scope of the disclosure. Indeed, the novel systems and methods described herein may be embodied in a variety of other forms; furthermore, various omissions, substitutions and changes in the form of the systems described herein may be made without departing from the spirit of the disclosure. The accompanying claims and their equivalents are intended to cover such forms or modifications as would fall within the scope and spirit of the disclosure.

What is claimed is:

1. An electronically controlled pump system comprising:

three or more pumps configured to pump fluid from a reservoir;

a plurality of sensors configured to generate a plurality of sense signals indicating a fluid level of the reservoir;

a user interface configured to receive a user input indicating a selected operating mode from a plurality of user-selectable operating modes; and a control circuit comprising logic circuitry configured to individually control activation of the three or more pumps based on the plurality of sense signals so as to control pumping of fluid from the reservoir, and a switching power supply circuit configured to convert an AC input voltage to a regulated DC voltage that powers the logic circuitry, wherein the logic circuitry is operable in the plurality of user-selectable operating modes associated with different pump activation sequences in response to the fluid level of the reservoir rising and the user input, wherein the plurality of user-selectable operating modes includes a standard mode in which the control circuit is configured to operate a first pump selected from the three or more pumps as a lead pump, a second pump selected from the three or more pumps as a lag pump, and a third pump selected from the three or more pumps as a lag/lag pump, and a jockey mode in which the control circuit is configured to operate the first pump as a jockey pump, the second pump as a first auxiliary pump, and the third pump as a second auxiliary pump, wherein in the standard mode, the control circuit is configured to activate the lead pump in response to the fluid level reaching a first fluid level, to activate the lead pump and the lag pump in response to the fluid level reaching a second fluid level above the first fluid level, and to activate the lead pump, the lag pump and the lag/lag pump in response to the fluid level reaching a third fluid level above the second fluid level, wherein in the jockey mode, the control circuit is configured to activate the jockey pump in response to the fluid level reaching the first fluid level, to turn off the jockey pump and activate the first auxiliary pump in response to the fluid level reaching the second fluid level, and to turn on the first auxiliary pump and the second auxiliary pump while maintaining the jockey pump off in response to the fluid level reaching the third fluid level, wherein the logic circuitry is further operable to rotate selection of at least a portion of the three or more pumps over time to reduce pump wear.

2. The electronically controlled pump system of claim 1, wherein the control circuit is configured to change which of the three or more pumps are selected as the lead pump, the lag pump, and the lag/lag pump over time to reduce pump wear.

3. The electronically controlled pump system of claim 1, wherein the control circuit comprises a jockey exercise timer circuit configured to intermittently activate at least one of the first auxiliary pump or the second auxiliary pump.

4. The electronically controlled pump system of claim 1, wherein the control circuit is operable to change the order that the first auxiliary pump and the second auxiliary pump are activated over time to reduce pump wear.

5. The electronically controlled pump system of claim 1, further comprising a multi-tap transformer including a primary winding having a plurality of taps for receiving two or more AC power supplies of different voltages, and a secondary winding configured to provide the AC input voltage to the switching power supply circuit.

6. The electronically controlled pump system of claim 1, wherein the control circuit does not comprise any microprocessor or microcontroller.

7. The electronically controlled pump system of claim 1, wherein the control circuit is configured to process a plurality of fault indication signals to determine a fault condition of the three or more pumps, and to change pump selection from one pump to another pump in response to detecting a fault.

8. The electronically controlled pump system of claim 1, further comprising a user interface configured to indicate at least one of a fault condition of the three or more pumps, a run condition of the three or more pumps, or an alarm condition of the fluid level.

9. The electronically controlled pump system of claim 8, wherein the control circuit is configured to receive a battery back-up voltage to power the user interface.

10. The electronically controlled pump system of claim 1, wherein the logic circuitry comprises: sensor logic configured to receive the plurality of sense signals, generate a run/rotate signal based on the plurality of sense signals and generate a timer reset signal based on the plurality of sense signals, fault logic configured to receive temperature and breaker fault indication signals for the first pump, the second pump, and the third pump, generate a fault/rotate signal based on the temperature and breaker fault indication signals, and generate a fault signal indicating whether or not a breaker is open for each of the first pump, the second pump, and the third pump, alarm logic configured to receive the fault signal from the fault logic and a first one of the plurality of sense signals indicating when the fluid level exceeds a high level indicating an overflow condition of the reservoir and/or the fluid level falling below a low level indicating that undesirably low liquid levels have been reached, and determine when to activate alarm outputs based on the fault signal and the first one of the plurality of sense signals, an auxiliary pump exercise timer configured to receive the timer reset signal from the sensor logic and generate an exercise/rotate signal based on the timer reset signal, and pump rotation and selection logic configured to:

receive the fault signal from the fault logic, the run/rotate signal from the sensor logic, and the exercise/rotate signal from the auxiliary pump exercise timer, activate or deactivate the first pump, the second pump, and the third pump based on the fault signal and the run/rotate signal, and activate at least one of the first auxiliary pump and the second auxiliary pump in place of the jockey pump based on the exercise/rotate signal.

* * * * *